United States Patent [19]

Watson

[11] 4,164,325

[45] Aug. 14, 1979

[54] HIGH-PRESSURE-ROTARY-NOZZLE APPARATUS

[76] Inventor: John D. Watson, 906 E. Harmony La., Fullerton, Calif. 92631

[21] Appl. No.: 853,254

[22] Filed: Nov. 21, 1977

[51] Int. Cl.[2] ..... B05B 3/06

[52] U.S. Cl. ..... 239/252; 137/167; 239/261; 239/DIG. 13

[58] Field of Search ..... 239/246, 251, 252, 261, 239/DIG. 13; 134/167 C, 168 C

[56] References Cited

U.S. PATENT DOCUMENTS

| | | | |
|---|---|---|---|
| 3,814,330 | 6/1974 | Masters | 134/167 C |
| 3,987,963 | 10/1976 | Pacht | 239/252 X |
| 3,994,310 | 11/1976 | Brandon | 239/246 X |

*Primary Examiner*—Richard A. Schacher
*Attorney, Agent, or Firm*—Francis X. LoJacono

[57] ABSTRACT

A high-pressure rotary nozzle for cleaning the insides of pipes and vessels associated with the agricultural and petroleum industries, as well as in geothermal plants. The rotary nozzle provides a plurality of high-velocity, rotating, fluid streams to remove unwanted material from the interior surfaces of the pipes and vessels, wherein the nozzle comprises a central supporting shaft through which fluid flows into the rotatably mounted rotor body, the body being provided with jet-spray heads canted either forwardly or rearwardly of the line of longitudinal travel, and including thrust bearings located against each end of the body. The rotating speed of the rotor body is controlled by a plurality of free-floating bearing balls which bear against a stationary cup member as the body rotates on the central shaft. Guide members are secured to the cup member, allowing the nozzle to be continuously and centrally aligned during its longitudinal travel within a pipe.

9 Claims, 5 Drawing Figures

HIGH-PRESSURE-ROTARY-NOZZLE APPARATUS

BACKGROUND OF THE INVENTION

1. Field of the Invention

This invention relates generally to a high-pressure nozzle and, more particularly, to a rotating, high-pressure nozzle that can dislodge various foreign deposits lining pipes and vessels.

2. Description of the Prior Art

Various types and designs of nozzles, including rotary nozzles, have been proposed for use in cleaning the interiors of pipes and like vessels. However, as is well known in the art, many problems and difficulties are encountered in providing a suitable means for cleaning deposits accumulated on the inner surfaces of the pipes used in new technological fields and in established fields such as the agricultural and petroleum industries—and particularly with geothermal plants.

As examples of the various designs and uses that have been disclosed, the following patents are presented as of interest thereto.

U.S. Pat. No. 3,814,330 discloses a nozzle for cleaning the interiors of pipes, wherein the material to be dislodged is the typical sediment debris normally found in sewer pipes.

U.S. Pat. No. 3,125,297 discloses a rotary-spray head also designed to facilitate the cleaning of the interiors of pipes and related vessels.

Other methods and working designs of nozzles can be found in U.S. Pat. No. 2,735,794; No. 3,744,723; No. 3,809,317; No. 3,856,570; and No. 3,120,346.

However, the above-related devices do not lend themselves to the proper nozzle configuration that can be applied to the new problem areas as herein mentioned, particularly with respect to conditions found in cleaning and dislodging very hard materials formed by the cooling of hot brine solutions having high concentrations of salts and minerals, wherein the depositing of different elements on the walls of pipes and vessels at different temperatures results in various types of scale build-up which has heretofore been relatively unknown in the art.

SUMMARY OF THE INVENTION

The new rotary nozzle has many applications in pipe and vessel cleaning in the agricultural and petroleum industries, as well as in geothermal plants.

Recent concern for the energy shortage and the search for new energy sources has focused attention on the practicability of capturing, processing, and using heat energy which exists in geothermal deposits throughout the world. Known geothermal zones exist in many areas of the western United States, Hawaii, Mexico, Iceland, New Zealand, Italy, Japan, and Russia. These geothermal sources produce dry steam, wet steam, or hot brine. This brine is found at depths of approximately 5,000 feet under high pressure with temperatures of approximately 400° F. The brine is taken from the wells and passed through a series of flash boilers and heat exchangers where a secondary fluid, isobutane, is vaporized and drives a steam turbine which, in turn, drives an electrical power generator. The spent isobutane vapor then passes through a condenser and is pumped back through the flash boilers and heat exchangers to be revaporized. The cooled geothermal brine passes out of the heat exchangers and is pumped back through a reinjection line and returned to the earth to prevent subsidence.

The hot brine contains a high concentration of salts and minerals including iron, lead, strontium, barium, lithium, boron, magnesium, and copper. Some of these solids settle out and deposit on the walls of the pipes and vessels. Depositing of different elements at different temperatures results in various types of scale build-up in different areas of the processing system. Some of these deposits are very thick but reasonably soft; others are thinner but harder and more difficult to remove. Typical scale in the 10-inch diameter reinjection line builds up to 16 to 17 pounds per foot of line before plant shutdown for removal.

Thus, the present invention comprises a central shaft which is adapted at one end to be affixed or secured to an inlet hose wherein the fluid flows through a central bore and discharges under very high pressure in a rotor body having a plurality of angularly arranged ports. These ports are formed to receive various types of nozzle heads whereby the fluid is projected outwardly at an angular displacement impinging against the foreign material lining the interior of the pipe or vessel.

The nozzle is so constructed that the rotational speed of the nozzle body is regulated or controlled in ratio to the amount of pressure of the fluid and its own rotational force. That is, there is provided a means by which the speed of the rotating body can not exceed a point wherein the force of the spray becomes ineffective, this means being provided by a plurality of bearing balls that centrifugally engage the annular wall of a stationary housing secured to the central shaft member. A plurality of guide members are mounted to the stationary housing extending outwardly therefrom to engage the surrounding interior pipe wall, whereby the nozzle can be aligned approximately along the longitudinal axis of the pipe and thus keeping the spray nozzle heads radially equidistant from the pipe wall as they rotate therein.

Seals are not used between the rotor body and the shaft, since the high-fluid pressure would result in excessive friction, preventing the rotor body from spinning. Instead, a precision fit with minimal clearance is provided between the rotor and the shaft. This clearance permits a controlled amount of fluid leakage which acts as a liquid bearing—separating, lubricating, and cooling the mating surfaces, which also cool and lubricate each adjacent thrust bearing.

The rotary nozzle can be pulled through a long section of pipe or vessel by attaching a cable to the eye in the end of the shaft; or it can be pushed by means of a rigid length of pipe attached to the inlet port end of the shaft. The nozzle is advanced at the desired rate, depending upon the thickness and characteristics of the material being removed.

OBJECTIVES AND ADVANTAGES OF THE INVENTION

The present invention has for an important object a provision whereby a high-velocity, rotating, fluid stream is discharged therefrom to remove accumulated deposits from the interior surfaces of items such as pipes, pressure vessels, etc.—these deposits being very hard and solid in nature.

It is another object of the invention to provide a better means for cleaning pipes and vessels that are clogged by high concentrations of salts and minerals caused by hot brine generated from geothermal deposits.

It is still another object of the invention to provide a high pressure, rotary nozzle that can be applied to an extremely wide range of pipe and vessel sizes, and still effectively remove a wide variety of deposits from the interior surfaces of these pipes and vessels.

It is a further object of the present invention to provide a rotary nozzle of this type wherein the rate of wear on all parts is minimal, and where no seals are required.

It is still a further object of the invention to provide a nozzle of this character that includes a guide that can effectively accommodate a wide range of pipe or vessel sizes wherein the nozzle is readily and centrally positioned along the longitudinal axis of the pipe or vessel.

Still another object of the invention is to provide a device of this character that is simple and rugged in construction, and yet provides performance characteristics, cleaning rate, and flushing action that can be readily varied to accommodate differences in the characteristics of the materials being removed.

It is still a further object of the present invention to provide a device of this character wherein the orifice size, the fluid-stream-cant angle, the fluid-stream-forward-lead angle, the fluid-flow rate, and the nozzle-travel rate can be readily changed for any particular requirement.

A still further object of the invention is to provide a rotary nozzle that can be used to clean pipes or vessels in place, without the need for removing them from their normal location of installation.

The characteristics and advantages of the invention are further sufficiently referred to in connection with the accompanying drawings, which represent one embodiment. After considering this example, skilled persons will understand that variations may be made without departing from the principles disclosed, and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
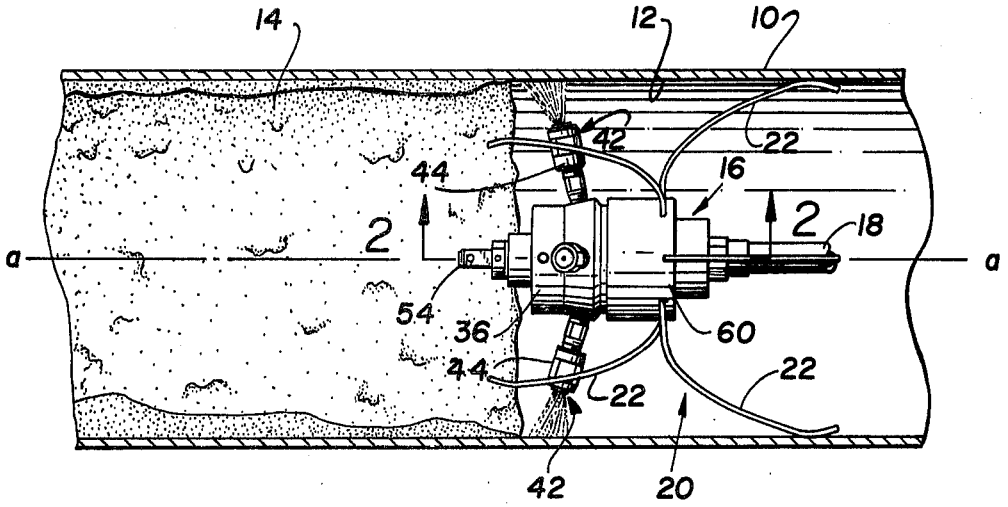
FIG. 1 is an elevational view of the high-pressure, rotary nozzle illustrating the invention in an operative environment and positioned within a section of pipe.

Referring to the accompanying drawings, and more particularly to FIG. 1, there is shown a pipe 10 wherein the interior wall 12 is lined with a foreign material 14, which represents a very hard deposit of highly concentrated salts and minerals, rather than the normal sediments found in sewer pipes.

Positioned within pipe 10 is the high-pressure, rotary-nozzle device, generally indicated at 16 and being connected to inlet-fluid hose 18. As further illustrated, there is a guide means, indicated generally at 20, having a plurality of extended guide wires or fingers 22, a more detailed description of which will hereinafter be provided.

Accordingly, however, guide means 20 provides for the longitudinal alignment of the nozzle device 16, so that its central axis is coaxially aligned with the longitudinal axis a—a of the pipe.

Thus, the present invention comprises a central, fluid-input shaft 24 having an enlarged-diameter boss member 26 formed with flat sides 28. The shaft includes a central passage or bore 30 with radially disposed communicating passages 32 whereby fluid under pressure is received therein by hose 18, hose 18 being connected to the enlarged boss member 28 which is provided with an enlarged threaded bore 34.

Figure 2:
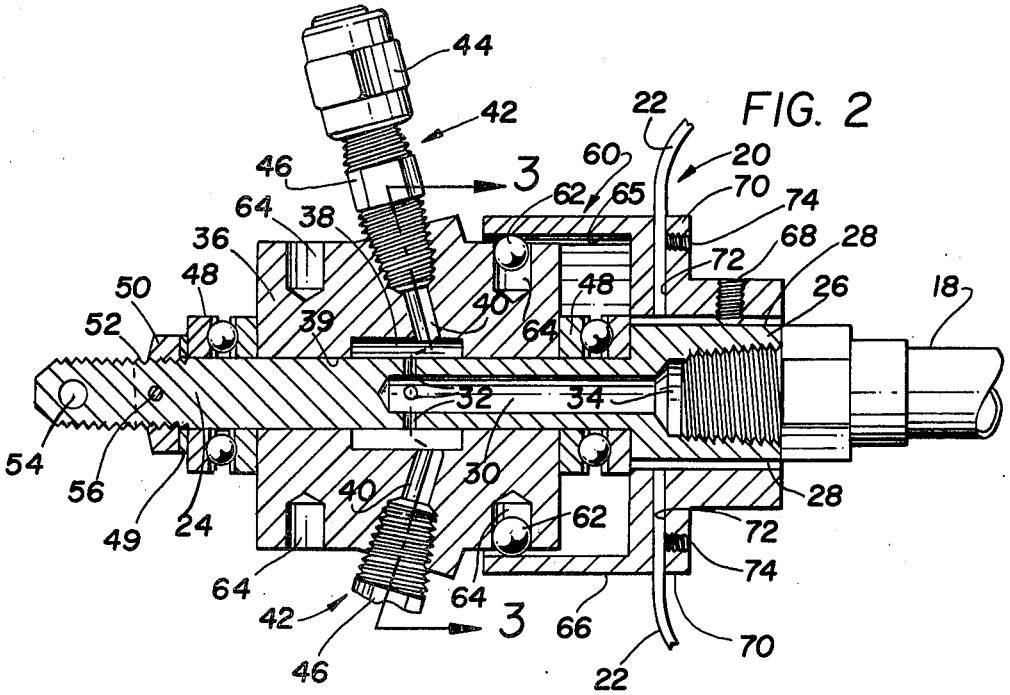
FIG. 2 is an enlarged, cross-sectional view thereof taken substantially along line 2—2 of FIG. 1.
Figure 5:
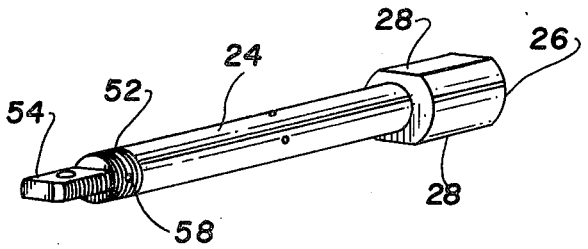
FIG. 5 is a perspective view of the central, fluid-input shaft.
Figure 3:
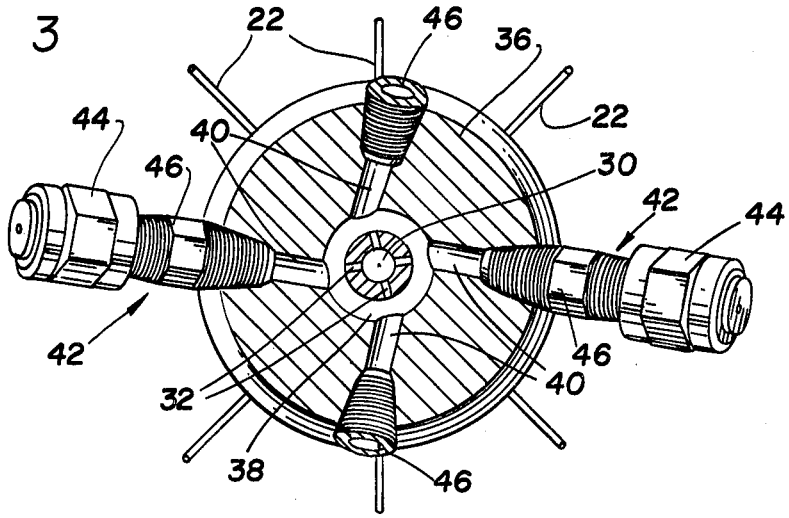
FIG. 3 is a cross-sectional view taken substantially along line 3—3 of FIG. 2.
Figure 4:
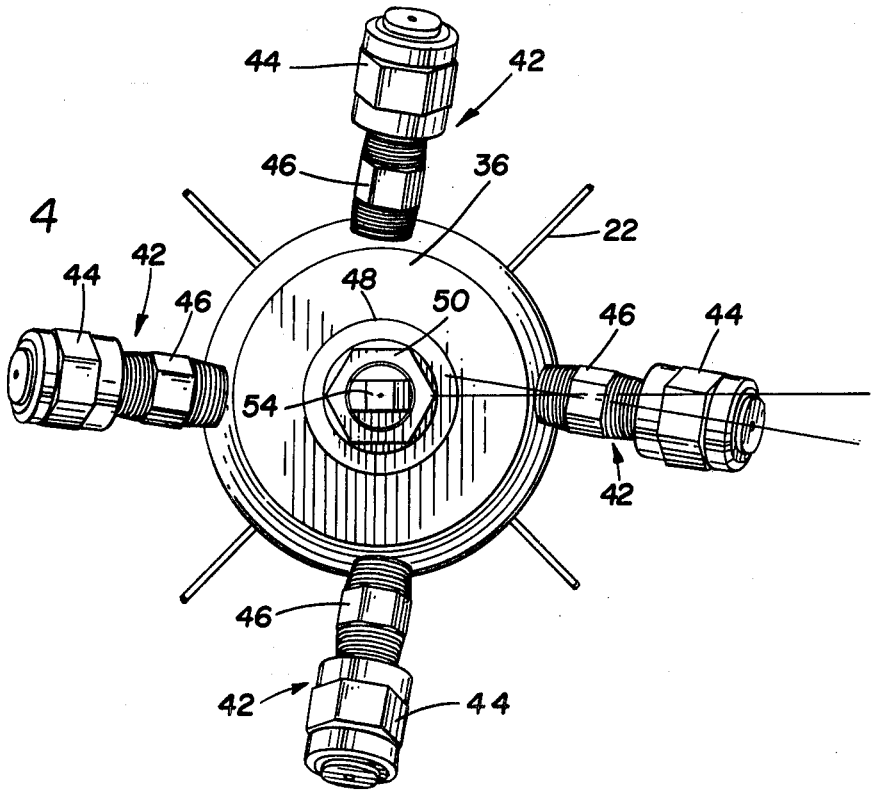
FIG. 4 is a front-elevational view of the present invention, showing the spray-nozzle heads being canted angularly to one side in order to provide rotation to the nozzle.

Rotatably mounted to shaft 24 is the main rotor body 36, body 36 being provided with a central cavity 38 formed intermediate the open ends of the longitudinal bore 39, wherein cavity 38 is arranged to be positioned so as to surround radial passages 32; whereby fluid flows into cavity 38 from passages 32 and discharges therefrom by means of a plurality of outlet ports 40 disposed radially and outwardly from central cavity 38, as seen in FIGS. 2 and 3.

It should be noted that outlet ports 40 are each angularly offset in two directions. That is, ports 40 are canted forwardly as seen in FIG. 2, and—in addition—angularly canted to one side as seen in FIG. 3. Each port terminates with a threaded portion wherein spray-nozzle means, indicated at 42, is removably received in each port 40. Hence, each nozzle means 42 is also canted at the angles set by respective ports 40.

Accordingly, nozzle means 42 mounted in the rotor body 36 are canted at compound angles, in order to impart rotational movement thereto and promote the loosening and peeling of the deposits of unwanted foreign matter from the inner surface of the pipe or vessel—and also to flush the removed material away from the nozzle. It should also be noted at this time that the rotor body 36 is reversible, whereby the nozzle means would be canted rearwardly on shaft 24, in order to permit either the flushing of loosened debris downstream ahead of the advancing nozzle, or—in the case of a heavy deposit—flushing the debris backward to prevent further clogging of the pipe by the accumulation of excessive build-up in the already narrowed passage.

The spray nozzle means comprises a nozzle-spray head 44, which may have any size spray opening that would be suitable for the particular debris in a particular vessel, and an orifice plug 46 that connects the spray nozzle head 44 to the main rotor body 36. The nozzle configuration can be applied to an extremely wide range of pipe or vessel sizes by making the parts larger or smaller and by use of the orifice plug 46, wherein the plug is employed as an extender fitting. In addition, separate extender fittings, such as elongated spoke-like tubes, can be adapted to be mounted to the central rotor body. (These tubes are not herein shown due to the obvious construction thereof.)

Before mounting main rotor body 36 freely on shaft 24, a bearing means such as thrust bearing 48 is positioned against boss member 26, after which body 36 is positioned thereon to contact bearing 48. Following body 36, a second thrust bearing 48 is located on shaft 24 against the opposite end of body 36, as seen in FIG. 2.

A washer 49 and a nut 50 are placed on the shaft by receiving the threaded end 52 of the shaft; and the threaded end is also provided with an eye member 54 integrally formed therein. The nut is sufficiently tightened to prevent all lateral play of the rotor body, yet will still allow the body to spin freely on shaft 24. Once the nut is in place, it is locked into position by pin 56 which is received in a transverse bore 58.

Rotational control means, generally indicated at 60, prevents excessive rotational speed of the body 36, so that there is no loss of the designed effectiveness and the proper impinging impact force of the fluid discharged from the spray heads.

Thus, the rotational control means 60 comprises a plurality of equally spaced bearing balls 62 adapted to be freely positioned within radial recesses 64. As seen in FIG. 2, balls 62 are located in the rearward section of the body 36, the recesses 64 being formed in both the forward end and the rearward end thereof so as to accommodate the bearing balls for reverse use of the rotor body 36, as previously mentioned.

As the rotor body 36 rotates, the centrifugal force developed thereby causes the bearing balls to outwardly engage the inner surface 65 of the cup member 66; and the cup member 66 is secured to the central shaft by any suitable means such as screw 68, whereby member 66 is fixed in a stationary manner.

Accordingly, as the rotational speed of the rotor increases, the bearing balls are forced outwardly against the inner surface 65 of cup member 66 by centrifugal force. The friction caused by the bearing balls contacting the surface 65 results in a retarding moment which limits the speed of rotation of the rotor body, thus maximizing the effectiveness of the fluid-jet streams.

It should be noted that seals are not used between the rotor body and the shaft, since the high-pressure fluid would result in excessive friction—preventing the rotor from spinning. Instead, a precision fit with minimal clearance is provided between rotor body 36 and shaft 24, wherein this clearance permits a controlled amount of fluid leakage which acts as a liquid bearing—separating, lubricating, and cooling means of the mating surfaces. Orifice sizes are established to provide the desired cutting velocity of the fluid streams—sonic velocity or greater—taking into account the leakage flow past the bearing surfaces.

Referring back to guide means 20 and the extended guide wires or fingers 22, the guide wires are removably mounted to the base portion 70 of the cup member 66. Base 70 includes a plurality of insert holes 72 and set screws 74 which engage the ends of fingers 22 when supported in holes 72. These fingers are so bent as to engage the inner wall of pipe 10; however, as shown in FIG. 1, every other finger guide is positioned in a reverse mode—that is, one group is formed and bent rearwardly, while others are bent forwardly. This provides a stable horizontal movement through pipe 10 whereby the nozzles are held at an equal, predetermined, spaced relationship to the wall and foreign debris or scale disposed thereon. In addition, considerable space is provided between the nozzle device and the inner wall to allow for uninterrupted emptying of fluid and broken debris from the pipe or vessel being cleaned.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A high-pressure rotary-nozzle apparatus comprising:

a central support shaft having a central passage with an open end and a closed end, including a plurality of radially disposed passages adjacent said closed end through which fluid is passed under high pressure from a hose affixed to said open end thereof, said shaft having an enlarged boss member formed thereon;

a main rotor body having a longitudinal bore including a central cavity disposed so as to allow said radial passages to be located in said cavity, said body including a plurality of radial discharge ports, said discharge ports being angularly canted relative to the longitudinal axis of said body;

bearing means positioned at each end of said rotor body to provide free rotation thereof about said shaft;

means for securing said bearing means and said rotor body for rotational movement on said shaft;

means for controlling the rotational speed of said body, said means being mounted between said body and said shaft;

guide means to coaxially position said apparatus along the longitudinal axis of a pipe; and spray-nozzle means mounted to said discharge ports so as to extend radially and outwardly from said rotor body, whereby said fluid is directed against the wall of said pipe to dislodge foreign debris therefrom as said spray-nozzle means is rotated with said rotor body.

2. A high-pressure, rotary-nozzle apparatus as recited in claim 2, wherein each of said discharge ports is angularly canted in two directions, the first direction being canted forwardly of said rotor body, and the second direction being canted to one side of said body.

3. A nozzle apparatus as recited in claim 2, wherein said bearing means comprises a pair of thrust bearings, one being disposed between said rotor body and said enlarged boss of said support shaft, and the other being positioned between said securing means and said rotor body.

4. A nozzle apparatus as recited in claim 3, wherein said rotor body is provided with a degree of clearance between said body and said shaft to provide leakage of fluid to said thrust bearings, whereby said bearings are lubricated and cooled.

5. A nozzle apparatus as recited in claim 4, wherein said means for controlling the rotational speed of said body comprises:

a plurality of radial recesses formed in said rotor body;

a plurality of bearing balls freely disposed in said recesses;

a cup member secured to said support shaft and positioned to allow engagement of said bearing balls therewith, said balls being forced outwardly against said cup member by the centrifugal force of the rotating rotor body, thereby limiting the rotational speed of said rotor body.

6. A nozzle apparatus as recited in claim 5, wherein said guide means comprises a plurality of elongated, flexible, wire fingers affixed to said apparatus and extending outwardly therefrom to engage the wall of a pipe.

7. A nozzle apparatus as recited in claim 6, wherein said spray-nozzle means comprises a nozzle head mounted in each of said discharge ports.

8. A nozzle apparatus as recited in claim 7, wherein said spray-nozzle means includes an orifice plug defining an extension fitting mounted between said rotor body and said nozzle head, so as to position said nozzle head at a predetermined location from the wall of a pipe.

9. A nozzle apparatus as recited in claim 5, wherein said support shaft includes an eye member disposed at one end of said shaft.

* * * * *